US005287702A

United States Patent [19]

Blackshaw et al.

[11] Patent Number: 5,287,702

[45] Date of Patent: Feb. 22, 1994

[54] CARBON DIOXIDE STORAGE WITH THERMOELECTRIC COOLING FOR FIRE SUPPRESSION SYSTEMS

[75] Inventors: Andrew L. Blackshaw, Dunwoody, Ga.; Donald W. Hering, Cincinnati, Ohio

[73] Assignee: Preferred $CO_2$ Systems, Inc., Fairfield, Ohio

[21] Appl. No.: 42,091

[22] Filed: Apr. 1, 1993

Related U.S. Application Data

[63] Continuation-in-part of Ser. No. 883,653, May 15, 1992, abandoned.

[51] Int. Cl.[5] ..... F65B 21/02

[52] U.S. Cl. ..... 62/3.2; 169/11; 67/47.1

[58] Field of Search ..... 62/45.1, 48.2, 47.1, 62/3.2, 3.6, 3.7; 169/11

[56] References Cited

U.S. PATENT DOCUMENTS

| | | |
|---|---|---|
| 2,068,119 | 1/1937 | Whitfield . |
| 2,143,311 | 1/1939 | Gentz . |
| 2,207,662 | 7/1940 | Edmundson . |
| 2,287,873 | 6/1942 | Geertz et al. . |
| 2,525,570 | 10/1950 | Williamson . |
| 3,314,242 | 4/1967 | Lefferts . |
| 3,823,567 | 7/1974 | Corini . |
| 3,973,938 | 8/1976 | Szabo et al. . |
| 4,287,720 | 9/1981 | Barthel . |
| 4,441,325 | 4/1984 | Bon-Mardion et al. . |
| 4,441,332 | 4/1984 | Wilkinson . |
| 4,441,901 | 4/1984 | Endoh . |
| 4,506,510 | 3/1985 | Tircot . |
| 4,593,529 | 6/1986 | Birochik . |
| 4,674,289 | 6/1987 | Andonian . |
| 4,682,472 | 7/1987 | Huard . |
| 4,711,270 | 12/1987 | Fornasari . |
| 4,730,459 | 3/1988 | Schickin et al. . |
| 4,732,588 | 3/1988 | Covert et al. . |
| 4,888,955 | 12/1989 | Tyree . |
| 4,897,226 | 1/1990 | Hoyle et al. . |
| 5,057,490 | 10/1991 | Skertic . |
| 5,060,479 | 10/1991 | Carmi et al. . |

FOREIGN PATENT DOCUMENTS

WO91/10477 7/1991 World Int. Prop. O. .

*Primary Examiner*—John M. Sollecito

*Attorney, Agent, or Firm*—Wood, Herron & Evans

[57] ABSTRACT

A long term pressurized carbon dioxide storage system for a fire suppression system includes an insulated tank (12) in communication with a chamber (52) chilled by a thermoelectronic refrigerator (50A, 50B) to condense carbon dioxide vapors and keep pressure in the tank below an upper limit to minimize boil off.

40 Claims, 4 Drawing Sheets

CARBON DIOXIDE STORAGE WITH THERMOELECTRIC COOLING FOR FIRE SUPPRESSION SYSTEMS

RELATED APPLICATIONS

This application is a continuation-in-part of our application Ser. No. 07/883,653 filed May 15, 1992, now abandoned, and entitled "Carbon Dioxide Storage for Fire Suppression Systems", the disclosure of which is incorporated herein by reference.

BACKGROUND OF THE INVENTION

I. Field of the Invention

The present invention relates to long term storage of gases under pressure and more specifically to long term storage of carbon dioxide under pressure so that it is available for use in a fire suppression system.

II. Description of the Prior Art

In a typical fire suppression system, carbon dioxide ($CO_2$), is maintained or stored in one or more pressure vessels (i.e., tanks or canisters). The pressure vessels are connected through a valve to a piping system for releasing the $CO_2$ in the area of a fire. As will be appreciated, it may be necessary to store the $CO_2$ for long periods of time in order to ensure availability of carbon dioxide in the event of a fire.

Two types of carbon dioxide storage systems have typically been employed for fire suppression systems. These two systems may be referred to as high pressure systems (e.g., about 850 psi) and low pressure systems (e.g., about 300 psi), respectively. Each type of system has provided much needed long-term storage of carbon dioxide, but not without some significant drawbacks.

Low pressure systems have typically been employed for storing extremely large quantities of carbon dioxide in excess of 1000 lbs. such as up to several tons. In order to prevent loss of carbon dioxide which could occur as the carbon dioxide warms up, low pressure systems typically also refrigerate the storage tanks. By refrigerating the tank, the carbon dioxide is kept in a liquid state such as at around 0° F. and thus is less likely to boil off. But maintaining the tank at such a cold temperature has conventionally required very large mechanical compressor-based refrigeration systems.

Compressor-based systems not only require substantial space, but they are very heavy, require periodic servicing, and utilize refrigerants, such as CFC's, which are known to be environmentally undesirable. And should the compressor system fail, lose power, or leak, not only might hazardous refrigerants be expelled into the environment, but the liquid carbon dioxide will begin to heat up and go into its vapor state where it might then boil off from the tank resulting in loss of fire suppression capability.

In those situations where lesser quantities of carbon dioxide are necessary (such as less than 1000 lbs.), high pressure systems are preferred. High pressure systems eliminate the refrigerator and its drawbacks, but at the expense of introducing a different set of problems. In high pressure systems, each pressure vessel is typically designed to hold no more than about 100 lbs. of carbon dioxide. Consequently, to provide sufficient carbon dioxide capacity to suppress fires, it is typical to connect several such pressure vessels together such as through a manifold. The complexity of multiple vessel systems and the space requirements imposed by adding tanks limits the utility of such high pressure systems to typically low capacity situations.

Further, because the carbon dioxide is stored under high pressure, it is not typical to refrigerate the tanks. Thus, refrigerators employed in larger systems are not necessary thereby eliminating the drawbacks associated therewith. But one result of not refrigerating the high pressure tanks is that, over time, carbon dioxide may boil off. To avoid losing so much of the $CO_2$ that the fire suppression system becomes ineffective or useless, periodic testing of the high pressure vessels becomes necessary.

Testing of the high pressure vessels typically requires that each tank be individually removed from the system and weighed. If the weight of the pressure vessel is too low (indicating loss of $CO_2$), then the tank must be recharged with more carbon dioxide. The tested tank must then be reconnected to the system. These tasks are not only time consuming and introduce human error, but if not done in a timely fashion could lead to a failure of the fire suppression system for lack of sufficient carbon dioxide.

To avoid $CO_2$ boiling off in the high pressure systems, it might be possible to refrigerate the tanks as done in low pressure systems. However, size considerations alone, not to mention weight and other problems of compressor-based refrigerators, militate against their use where only low quantities of $CO_2$ (less than 1000 lbs.) are needed for the fire suppression system.

SUMMARY OF THE INVENTION

The present invention provides a long term pressurized gas storage system, such as for carbon dioxide for use in a fire suppression system, which overcomes the above-mentioned drawbacks. More specifically, the present invention provides a low pressure system which does not have the drawbacks introduced by compressor-based refrigerators of conventional low pressure systems nor the boil off and persistent testing drawbacks of high pressure systems. To this end, and in accordance with the principles of the present invention, a small chamber is coupled, such as via a tube, to the interior of an insulated pressure vessel charged under low pressure (e.g , to about 300 psi) with $CO_2$. To prevent boil off, a thermoelectronic refrigerator is attached to the chamber to chill the chamber.

The thermoelectronic refrigerator is much smaller than conventional compressor-based systems and, further, uses no refrigerant chemicals to harm the environment. Moreover, chilling of the chamber alone is believed to be sufficient. Consequently, the thermoelectronic refrigerator may be small enough to equip the pressure vessel with its own refrigerator connected to the tank. Such a pressure vessel might be designed to hold up to 1000 lbs. of carbon dioxide thus providing, with one tank, a meaningful and advantageous substitute for multiple vessel high pressure systems. Where more capacity is needed, one or more such thermoelectronic refrigerator-equipped tanks may be manifolded together.

In accordance with a further aspect of the present invention, the thermoelectronic refrigerator is selectively energizable so that it may be turned on only when necessary. To this end, a pressure sensor or switch monitors the pressure within the tank and causes the thermoelectronic refrigerator to turn on when the pressure exceeds an upper limit, such as 305 psi and to turn off when the pressure falls below a lower limit, such as 295 psi. In this way, overchilling of the carbon dioxide is avoided while also providing resistance to boil off over the long term.

By virtue of the foregoing, there is thus provided a long term pressurized gas storage system which is compact and does not employ deleterious refrigerants, yet is still capable of providing sufficient heat removal to maintain carbon dioxide, for example, in a liquid state within a pressure vessel for extended periods of times thus making low pressure storage containment viable for even low capacity fire suppression systems.

These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above, and the detailed description of the embodiments given below, serve to explain the principles of the invention.

DETAILED DESCRIPTION OF THE DRAWINGS

Figure 1:
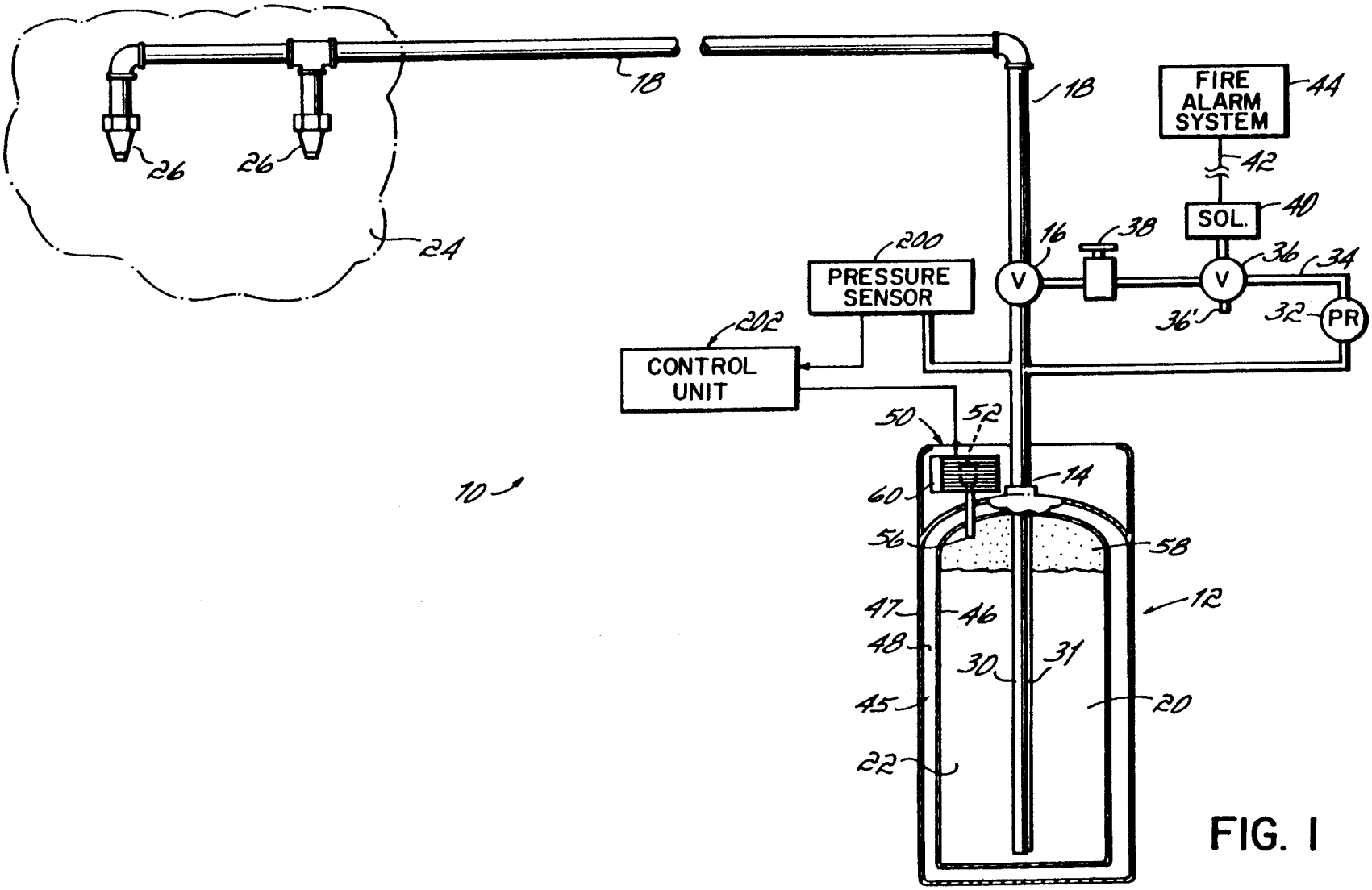
FIG. 1 is a schematic representation of a fire suppression system utilizing a pressure vessel, shown cut away, equipped with a thermoelectronic refrigerator in accordance with the principles of the present invention.

With reference to FIG. 1, there is shown a fire suppression system 10 incorporating a low capacity (e.g., less than 1000 lb.) storage pressure vessel or tank 12 coupled via outlet connection 14 and valve 16 to system piping 18 for dispersing carbon dioxide ($CO_2$) 20 from the interior 22 of tank 12 into the area 24 of a fire or the like to be contained or suppressed by the $CO_2$. A plurality of nozzles 26 attached to piping 18 spread the $CO_2$ into area 24 as is conventional. Extending into the interior 22 of tank 12 is a dip tube 30 coupled to outlet connection 14 and through which carbon dioxide 20 is emptied from tank 12 as is well understood. Also connected to connection 14 is a copper tube 31 for filling tank 12. Tube 31 extends to the bottom of the tank to eliminate the need for a vapor return line. Carbon dioxide 20 within tank 12 is to be kept under low pressure such as at about 300 psi. Outlet connection 14 is coupled to a pressure regulator 32 to provide reduced pressure via pneumatic actuation line 34 and electrically actuated 3-way valve 36 to the pneumatic operator 38 of valve 16. The solenoid 40 of valve 36 receives a signal over line 42 from a fire alarm system represented as at 44 by which to control opening and closing of main valve 16.

Normally, when no fire alarm condition is present, the signal on line 42 is a 0 volt DC signal, for example, such that solenoid 40 is deenergized and valve is 36 closed. With valve 36 closed, operator 38 is coupled via valve 36 to atmosphere (36'). Operator 38 in turn holds valve 16 shut so that no $CO_2$ is expelled into area 24. In the event of a fire or the like, system 44 initiates a 24 volt DC signal on line 42 energizing solenoid 40 to open valve 36 thereby coupling operator 38 over line 34 to pressure (e.g., 100 psi) from regulator 32. As a consequence, operator 38 increases its pressure supply and causes valve 16 to open expelling carbon dioxide 20 from within tank 12 out through piping 18 and nozzles 26 to suppress the fire in area 24.

The above-described aspects of system 10 are conventional and operate in conventional manner. In accordance with the principles of the present invention, tank 12 is adapted to store the carbon dioxide 20 in a low pressure environment requiring refrigeration but in quantities normally associated with high pressure systems. To this end, it is desired to keep the $CO_2$ in a liquid state at about 0° F. But as tank 12 gains heat from its surrounding environment, the liquid carbon dioxide 20 will begin to vaporize and pressure within the tank will increase.

In order to maintain carbon dioxide 20 in the liquid state at the appropriate pressure levels within tank 12, the tank is provided with a vacuum jacket 45 to minimize heat gain into the tank and a thermoelectronic refrigerator 50 to chill the $CO_2$. Tank 12 includes an inner wall 46 of stainless steel constructed and inspected to conform to Section VIII of ASME (American Society of Mechanical Engineers) standards and able to withstand working pressures of at least 325 psi. Vacuum jacket 45 comprises inner wall 46 and outer wall 47 spaced apart from wall 46 to define a space 48 therebetween which is filled with insulation (not shown). A full vacuum (−14.7 psi) is drawn on space 48 between walls 46 and 47 to provide insulative properties to tank 12. One such tank is the LIQUIDATOR TCM tank sold by Taylor Wharton Corp.

With respect to refrigerator 50, to eliminate the drawbacks associated with compressor-based systems, thermoelectronics are employed. As will be appreciated, thermoelectronic cooling devices utilize the heat transfer characteristics of semiconductor chips to "pull" heat out. This phenomena, known as the Peltier effect, has previously been proposed for chilling the pressure vessel itself or for chilling the space within the tank. While thermoelectronic refrigerators are smaller and safer than compressor-based refrigerators, it was thought that so many of the devices would be necessary to cool a tank the size of tank 12 (or larger) or the interior space thereof that, prior to this invention, thermoelectronic refrigerators were considered impractical for use in long term storage of $CO_2$ for fire suppression systems.

In accordance with the principles of the present invention, especially where the pressure vessel is vacuum insulated, only a portion of the vapor phase $CO_2$ needs to be chilled, thus allowing use of relatively few thermoelectronic cooling devices. To this end, coupled to tank 12 is a chamber 52 which is selectively chilled by refrigerator 50. Chamber 52 is coupled via tube 56 to the interior 22 of tank 12. Chamber 52 is advantageously elevated relative the liquid level of $CO_2$ within tank 12 such as by placing chamber 52 atop and outside of tank 12 as seen in FIG. 1. As also seen in FIG. 1, tube 56 terminates into tank 12 in an uppermost portion of the tank.

Figure 2A:
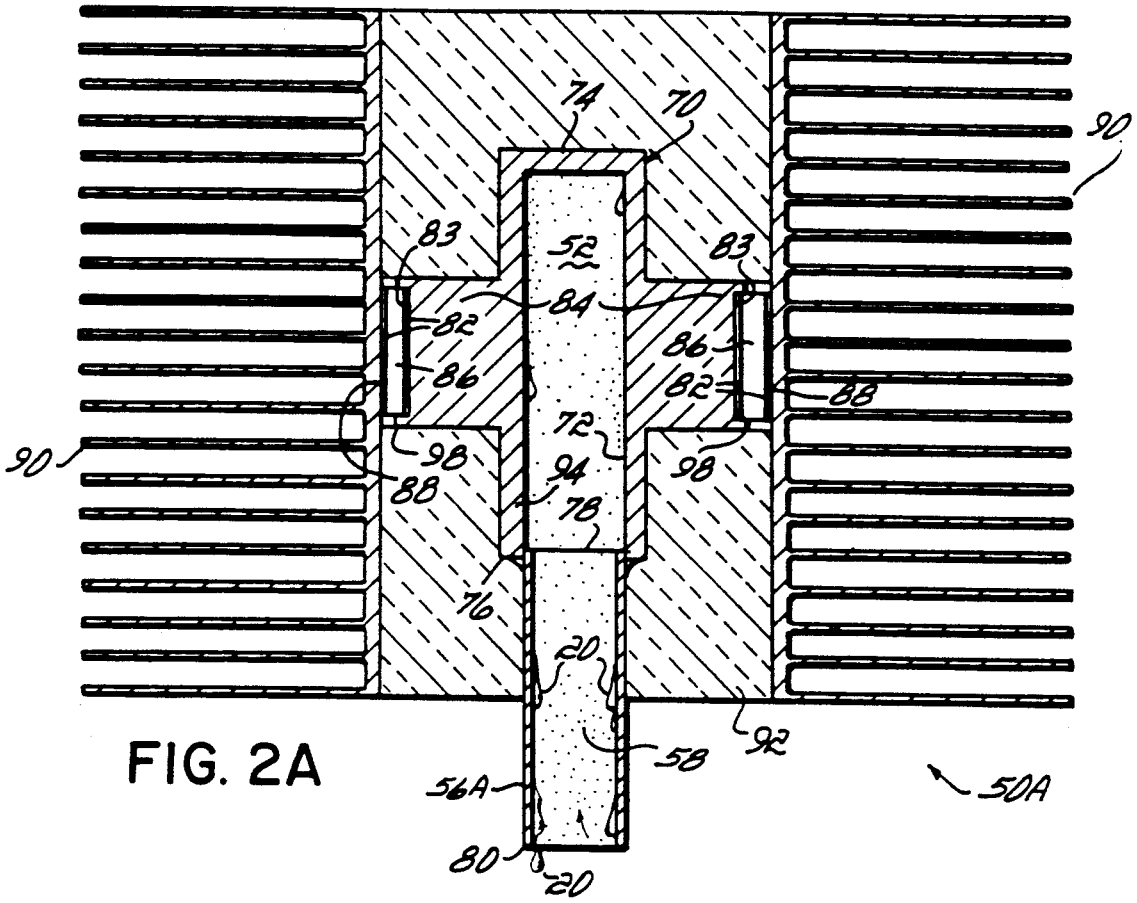
FIG. 2A is a cross-sectional view of one embodiment of a thermoelectronic refrigerator and cooling chamber attached to the pressure vessel of FIG. 1.

As carbon dioxide 20 warms up, it will enter into a vapor phase as represented at 58. As more vapors appear, pressure within tank 12 increases thereby increasing the possibility of boil off. The vapors pass up tube 56 and into chamber 52 whereat the vapors are chilled by thermoelectronic refrigerator 50. The chilled vapors condense and fall back into the interior 22 of tank 12 thereby reducing pressure in tank 12. A fan 60 may be provided with thermoelectronic refrigerator 50 to blow room air over the thermoelectronic refrigerator 50 to thereby facilitate heat removal. Two Embodiments (50A and 50B) of thermoelectronic refrigerator 50 will be described in greater detail with reference to FIGS. 2A and 2B. Turning to FIG. 2A, refrigerator 50A is comprised of T-shaped copper block 70 having a machined bore 72 therein defining chilling chamber 52. The bore is sealed at the top 74 of block 70 and open at the bottom 76 for connection to the distal end 78 of tube 56A. Tube 56A is a 1 to 1⅛ inch outer diameter type "K" copper tube about 9–10 inches in length. Bore 72 has a diameter about equal to the outer diameter of tube 56A so that one inch of the distal end 78 of tube 56A may be inserted therein and silver brazed in place. The proximal end 80 of tube 56A is inserted through vacuum jacket 45 of tank 12 and into the interior thereof and welded into place. To this end, tank 12 may be provided with a short length of tubing already in place extending from interior 22 through vacuum jacket 45 and to which the proximal end 80 of tube 56A may be welded.

Mounted, such as with a thin film of Wakefield Engineering type 120 thermal grease 82, at the distal end 83 of T-arms 84 of block 70 are a pair of thermoelectronic modules 86 such as Melcor type 25C055045-127-63L devices. Mounted, again with thermal grease, to the outer surface 88 of each thermoelectronic module 86 is an aluminum 6.0 inch by 7.4 inch heat sink 90 to help extract heat away from thermoelectronic modules 86. Heat sinks 90 may be EG&G Wakefield Model 6437. In the space between heat sinks 90, and surrounding copper block 70, is foam insulation 92 to minimize the likelihood of heat gain into chilling chamber 52 from the environment around pressure vessel 12 or heat sinks 90.

Figure 3:
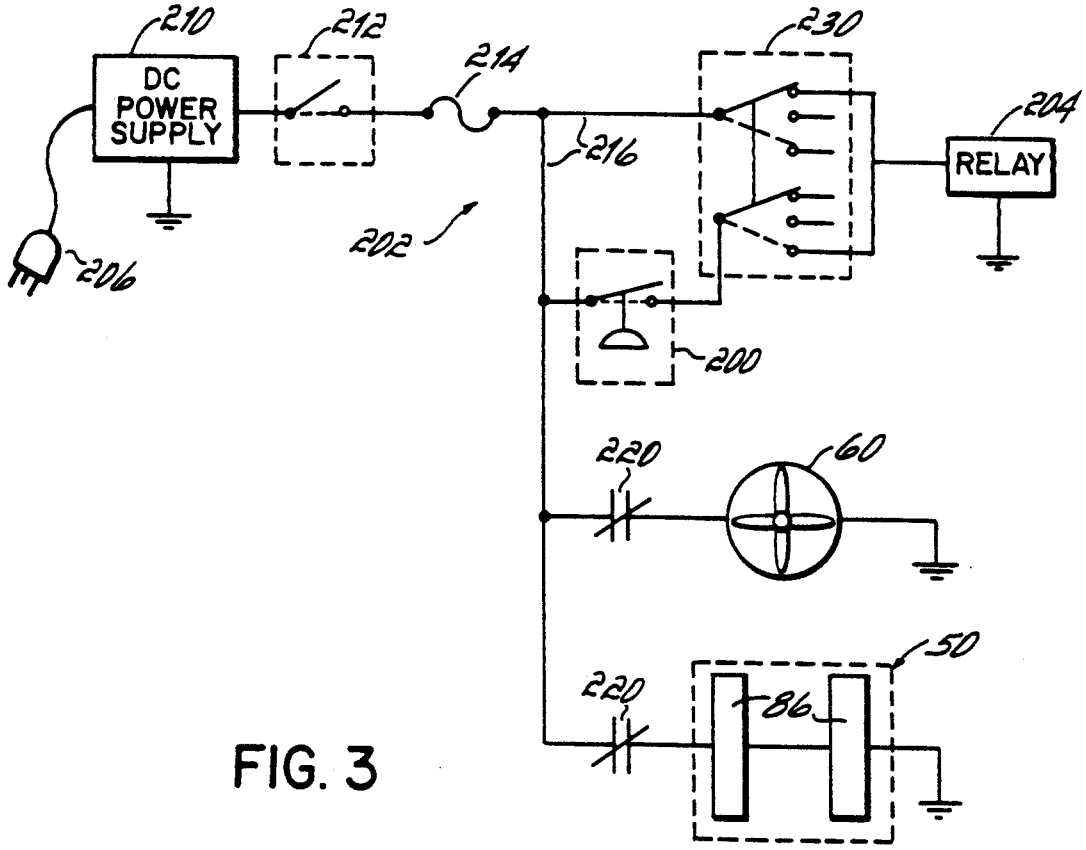
FIG. 3 is an electrical schematic of the control unit for the thermoelectronic refrigerators of FIGS. 2A and/or 2B.

T-shaped copper block 70 has a height between ends 74 and 76 of approximately 4.5 inches; a length between distal arm ends 83 of approximately 3.7 inches; a length between arms 84 of about 1.75 inches; each arm 84 situated approximately 1.38 inches below end 74 and being approximately 1.75 inches thick from top to bottom as seen in FIG. 3. Additionally, copper block 70 is approximately 1.75 inches thick in the direction facing into FIG. 2A. Chamber 52 is machined into copper block 70 to a diameter of approximately 1.13 inches and a depth of about 4.12 inches such that the side walls 94 of block 70 are at least about 0.31 inches thick and the top wall at distal end 74 is about 0.38 inches thick.

Distal ends 83 of arms 84 are recessed approximately 0.03 inches and the sidewalls 98 thereof approximately 0.06 inches thick to contain modules 86. Each such recessed surface may be brazed with Sil-Phos rod and machined flat.

Figure 2B:
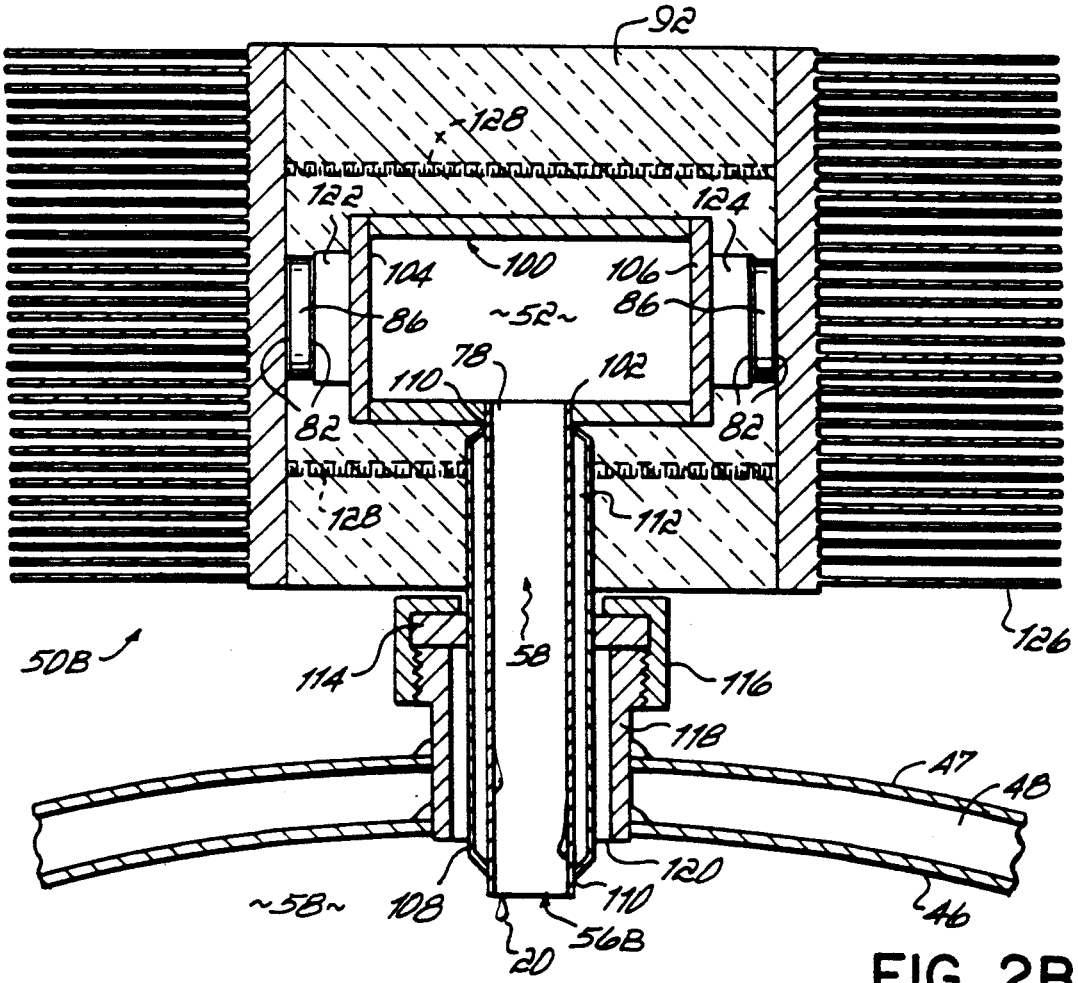
FIG. 2B is a cross-sectional view of another embodiment of a thermoelectronic refrigerator and cooling chamber attached to the pressure vessel of FIG. 1.

Turning to FIG. 2B, refrigerator 50B differs from refrigerator 50A in that tube 56B is also insulated and cooling chamber 52 is simpler to make. To these ends, chamber 52 is defined by a 2.5 inch outer diameter piece of type "K" copper tubing 100 having about a 3/32 wall thickness. Tubing 100 is 4½ to 5¾ inches long and is placed transverse tube 56B with an aperture 102 in the sidewall thereof through which distal end 78 of tube 56B is connected to communicate with chamber 52 inside tube 100. Tube 100 may actually be part of a copper tee with the leg being brazed (such as with Sil-Phos rod) to tube 56B. The ends of tube 100 are sealed by 2.5 inch square, ½ inch thick copper block end plates, 104, 106 brazed with Sil-Phos rod over the tube ends. Tube 56B is 1¼ inch outer diameter, 3/32 inch thick wall, type "K" copper tube about 12 inches in length. Surrounding tube 56B is a 2¼ inch O.D., 3/32 inch thick, type "K" copper outer shell 108 spaced around tube 56B and rolled and brazed (with Sil-Phos rod) at its respective ends 110 to tube 56B to define a space 112 in which a vacuum is drawn to thus further insulate tube 56B.

As seen in FIG. 2B, an annular 3/32 inch thick, two inch diameter copper collar 114 is brazed to outer shell 108 to support a nut 116 rotatably supported about tube 56B. Nut 116 threadably mates with spigot connection 118 brazed to walls 46 and 47 of tank 12 to define an aperture 120 into tank 12 for tube 56B. Aperture 120 is advantageously wider (e.g., has a diameter of about 3 inches) than tube 56B and shell 112 such that neither tube 56B nor its shell 112 directly contact the walls of tank 12, but still allow vapor phase and condensed $CO_2$ to communicate between tank interior 22 and chamber 52.

Mounted to the faces of end pieces 104, 106 are 2½ inch diameter copper spacer blocks 122, 124, respectively. Blocks 122, 124 are ⅜ inch thick. Mounted, such as with a thin film of Wakefield Engineering type 120 thermal grease 82 to the exposed faces of spacer blocks 122, 124 are a pair of thermoelectronic modules 86 such as Melcor type 16409-1 two stage cascaded thermoelectronic modules. If larger thermoelectronic modules are used, spacer blocks 122, 124 may be dispensed with and the modules held directly to the faces of end pieces 104, 106. Mounted, again with thermal grease, to the outer surface 88 of each thermoelectronic module 86 is an aluminum 7½ inch by 6⅝ inch finned heat sink 126 to help extract heat away from thermoelectronic modules 86. Heat sinks 126 may be Aavid Engineering, Inc. (Laconia, N. H.), Part No. 42009U57 and bolted together by four connecting rods 128 (only two shown). In the space between heat sinks 126, and surrounding copper tube 100, is foam insulation 92 to minimize the likelihood of heat gain into chilling chamber 52B from the environment around pressure vessel 12 or heat sinks 126.

The entire assembly of heat sinks 126, and copper tube 100 and foam 92 may be enclosed in a housing 130 (see FIG. 2C) with the fan 60 at one end (e.g., the end as would be seen facing the page in FIG. 2B) to pull air through the opposite end of the housing and over the fins of heat sinks 126 to thereby dissipate heat therefrom.

Figure 2C:
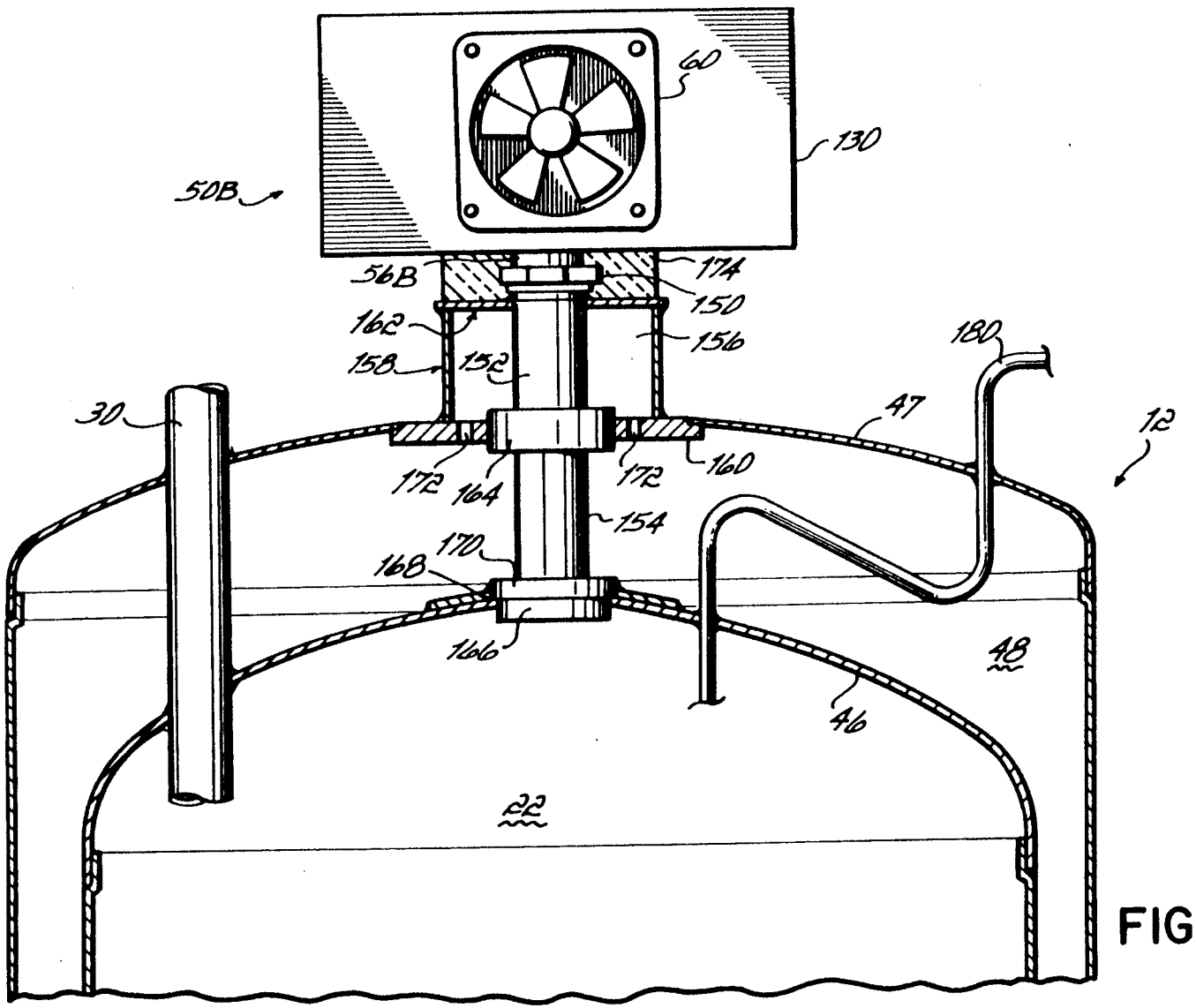
FIG. 2C is a partially cut-away view of an alternative connection of the thermoelectronic refrigerator of FIG. 2B to the pressure vessel.

Cooling unit 50B may alternatively be mounted to tank 12 as shown in FIG. 2C in which the interconnecting tube is comprised mostly of neck tubes positioned inside a vacuum jacketed space defined on tank 12. To this end, tube 56B is cut short so that only a small length protrudes out of refrigerator 50B to be held within compression coupling 150. Although some portion of tube 56B is seen in FIG. 26C, it will be appreciated that it may be fully within coupling 150. Coupling 150 connects tube 56B to upper and lower neck tubes 152, 154 which are held within vacuum jacketed spaces 156, 48, respective of tank 12. Space 156 is defined by 4 to 5 inch stainless steel tube 158 which is welded to outer reinforcing plate 160 welded to tank wall 47, and top wall 162 welded to tube 158. Coupling 150 is welded to top wall 162 with 1½ inch diameter stainless steel upper neck tube 152 welded to coupling 150 and to flange 164 machined from roll bar. Flange 164 is also welded to reinforcing plate 160 to separate spaces 156 and 48. Welded to flange 164 and neck adaptor 166 is 3 inch diameter lower neck tube 154. Neck adaptor 166 is formed from round bar and machined with a lip 168 to be welded into place to tank innerwall 46 along with lower inner reinforcing plate 170.

Outer reinforcing plate 160 is provided with four apertures 172 (only two shown) to permit vacuum communication between vacuum spaces 48 and 156 to thus provide a complete vacuum jacket insulation about neck tubes 152 and 154. Between refrigerator unit 50B and top wall 162 is foamed-in or molded foam insulation 174 to surround compression coupling 150 and reduce heat transfer between cooling unit 50B and tank 12, and insulate compression coupling 150 from the environment.

By virtue of the foregoing arrangement, it may be seen that tube 56B cooperates with neck tubes 152, 154 to communicate $CO_2$ vapors and liquid between tank interior 22 and cooling chamber 52 (see FIG. 2B). In this manner, these tubes cooperate to define an interconnecting tube between refrigerator 50B and the interior of the tank, which interconnecting tube is within a vacuum space and may thus be seen to be vacuum jacketed.

An instrument line 180 may be coupled through tank walls 46 and 47 for connecting to pressure sensors, liquid level sensors, and/or to provide a fill line as desired.

When a voltage, such as 26 volts DC, is applied to thermoelectronic modules 86, they will withdraw heat from chilling block 70 (refrigerator 50A) or tube 100 (refrigerator 50B) thereby chilling chamber 52. In order to prevent overcooling of system 10 and wasting energy, it is desired to selectively energize thermoelectronic refrigerator 50 as needed. To this end, a pressure sensor or switch 200 (such as a PA series two stage available from Automatic Switch Company) is also coupled to outlet connection 14 of tank 12 which switch opens at approximately 305 psi and closes at approximately 295 psi to control turning refrigerator 50 (and fan 60) on and off by unit 202. To this end, and with reference to the schematic of FIG. 3, a control unit 202 includes relay 204 to turn refrigerator 50 on and off as will now be described.

Control unit 202 is powered from a source of 115 volt AC such as from plug 206. The AC power source is coupled to 26 volt DC power supply 210 to provide 26 volts rectified and filtered DC for operating relay 204, fan 60 and series-connected modules 86. Unit 202 is turned on when switch 212 is closed (in the dotted line position) so that DC power flows through 15 amp fuse 214 to power rail 216. As will be appreciated, fan 60 and refrigerator 50 are on, i.e., energized when the two pairs of contacts 220 of relay 204 are closed. When no power is coupled to relay 204, contact pairs 220 are normally closed, but they open, to turn refrigerator 50 and fan 60 off, when relay 204 is energized. Relay 204 is energized directly from rail 216 via DPDT switch 230 when it is in the first position shown in solid line in FIG. 3. When switch 230 is in the center position, relay 204 is deenergized. And in the third position of switch 230, shown in dotted line, relay 204 is energized only when pressure switch 200 is closed (as shown in dotted line in FIG. 3), but deenergized otherwise.

In the third, or "auto", position of switch 230, refrigerator 50 is turned on and off in accordance with the pressure in tank 12. To this end, as pressure in tank 12 increases and exceeds an upper limit, such as 305 psi, switch 200 opens as shown in solid line. As a consequence, relay 204 is deenergized and contact pairs 220 close thereby turning refrigerator 50 and fan 60 on to chill chamber 52. As chamber 52 chills, pressure will drop in tank 12. As the pressure falls below a lower limit, such as 295 psi, switch 200 closes thereby energizing relay 204, opening contact pairs 220, and turning refrigerator 50 and fan 60 off.

As will be appreciated, relay 204 is configured in a fail-safe mode such that as long as power switch 212 is in the on state and fuse 214 is not blown, refrigerator 50 and fan 60 will be energized to chill chamber 52 whenever relay 204 is not energized.

In use, tank 12 is filled with carbon dioxide 20 in conventional manner to a pressure of approximately 300 psi. That pressure is communicated through pressure regulator 32 to valve 36 which causes operator 38 to close valve 16 thereby maintaining carbon dioxide 20 within tank 12. Over time, tank 12 warms slightly causing liquid carbon dioxide 20 to go into the vapor state and raise pressure within vessel 12. As the pressure increases to the upper limit, sensor 200 causes thermoelectronic refrigerator 50 to energize. Chamber 52 is chilled thereby condensing any carbon dioxide vapors within chamber 52. The condensed vapors fall back into vessel 12 and lowers the pressure thereof. As the pressure falls to the lower limit, thermoelectronic refrigerator 50 is deenergized thereby preventing over-chilling of the carbon dioxide or wasting energy unnecessarily. In the event a fire condition is detected in area 24, fire alarm system 44 initiates a 24 volt DC signal on line 42 energizing solenoid 40. Valve 36 is thus turned on introducing the 100 psi pressure to operator 38 which causes valve 16 to open. Liquid carbon dioxide 20 is expelled out of outlet connection 14 and through system piping 18 to be dispersed in area 24 of the fire via nozzles 26.

Tank 12 is adapted to maintain carbon dioxide 20 in a liquid state at low pressure, that is below about 300 psi. In order to satisfy NFPA 12 requirements, a second pressure switch (not shown) is coupled to outlet connection 14 to provide a signal to close a set of contacts (also not shown) to thereby set off an alarm if the pressure within the tank exceeds a maximum threshold such as 315 psi or falls below a minimum acceptable pressure level such as below 250 psi. As will be understood, switch 230 could be a SPDT switch wired with rail 226, switch 200 and relay 204 to provide the three on, off and auto positions.

While the present invention has been illustrated by a description of a preferred embodiment thereof, and while the embodiment has been described in considerable detail, it is not the intention of applicants to restrict or in any way limit the scope of the appended claims to such detail. Additional advantages and modifications will readily appear to those skilled in the art. For example, control unit 202 may include a 28 volt re-chargeable battery back-up (not shown) coupled to power rail 216, to provide ongoing operation of thermoelectronic refrigerator 50 in the event of a loss of AC power, thereby further ensuring that the $CO_2$ will be maintained for long term storage. Control unit 202 may be adapted to monitor and visually indicate loss of AC power, low tank pressure, high tank pressure, and low pneumatic and actuation line pressure. Further, multiple tanks 12, each with its own thermoelectronic refrigerator 50 and chilling chamber 52 may be provided for large capacity when needed. The invention in its broader aspects is therefore not limited to the specific details, representative apparatus and method, or the illustrative example shown and described. Accordingly, departures may be made from such details without departing from the spirit or scope of applicants' general inventive concept.

What is claimed is:

1. A system for maintaining $CO_2$ under pressure comprising:

a pressure vessel having an interior for containing the $CO_2$ under pressure;

a chamber outside the pressure vessel; a tube interconnecting the chamber and the pressure vessel in fluid communication and terminating into the pressure vessel in an uppermost region of the pressure vessel interior; and thermoelectronic refrigerator means communicating with the chamber for chilling the chamber whereby to chill $CO_2$ within the chamber and thereby reduce pressure within the pressure vessel.

2. The system of claim 1, the chamber being elevated above the pressure vessel.

3. The system of claim 1 further comprising a vacuum jacket associated with the pressure vessel.

4. The system of claim 1 wherein the thermoelectronic refrigerator means is selectively energizable, the system further comprising:

a pressure sensor coupled to the pressure vessel for sensing the pressure therein; and control circuitry being responsive to the pressure sensor so as to selectively energize the thermoelectronic refrigerator means.

5. The system of claim 4, the control circuitry including means for energizing the thermoelectronic refrigerator means when the sensed pressure exceeds an upper limit.

6. The system of claim 5, the upper limit being approximately 305 psi.

7. The system of claim 5, the control circuitry further including means for deenergizing the thermoelectronic refrigerator means when the sensed temperature falls below a lower limit.

8. The system of claim 7, the lower limit being approximately 295 psi.

9. The system of claim 4, the control circuitry including means for deenergizing the thermoelectronic refrigerator means when the sensed pressure falls below a lower limit.

10. The system of claim 9, the lower limit being approximately 295 psi.

11. The system of claim 1 further comprising a tube interconnecting the vessel interior and the chamber.

12. The system of claim 11 further comprising a vacuum jacket associated with the interconnecting tube.

13. The system of claim 12 further comprising a coupling between the interconnecting tube and the vessel interior which holds the vacuum jacket spaced from the pressure vessel walls.

14. The system of claim 11 further comprising a coupling between the interconnecting tube and the vessel interior which holds the interconnecting tube spaced from the pressure vessel walls.

15. The system of claim 1 further comprising a tube communicating with the vessel interior, the chamber being defined at a distal end of the tube.

16. The system of claim 15 further comprising a vacuum jacket associated with the interconnecting tube.

17. The system of claim 16 further comprising a coupling between the interconnecting tube and the vessel interior which holds the vacuum jacket spaced from the pressure vessel walls.

18. The system of claim 15 further comprising a coupling between the interconnecting tube and the vessel interior which holds the interconnecting tube spaced from the pressure vessel walls.

19. A $CO_2$-based fire suppression system comprising:

a pressure vessel having an interior for storing the $CO_2$ under pressure, the pressure vessel having an outlet through which the stored $CO_2$ may be expelled;

valve means connected to the outlet for selectively permitting $CO_2$ to be expelled from the vessel outlet;

conduit means connected to the valve means for dispersing the expelled $CO_2$;

a chamber outside the pressure vessel; a tube interconnecting the chamber and the pressure vessel in fluid communication and terminating into the pressure vessel in an uppermost region of the pressure vessel interior; and thermoelectronic refrigerator means communicating with the chamber for chilling the chamber whereby to chill $CO_2$ within the chamber and thereby reduce pressure within the pressure vessel.

20. The system of claim 19, the chamber being elevated above the pressure vessel.

21. The system of claim 19 further comprising a vacuum jacket associated with the pressure vessel.

22. The system of claim 19 wherein the thermoelectronic refrigerator means is selectively energizable, the system further comprising:

a pressure sensor coupled to the pressure vessel for sensing the pressure therein; and control circuitry being responsive to the pressure sensor so as to selectively energize the thermoelectronic refrigerator means.

23. The system of claim 22, the control circuitry including means for energizing the thermoelectronic refrigerator means when the sensed pressure exceeds an upper limit.

24. The system of claim 23, the upper limit being approximately 305 psi.

25. The system of claim 23, the control circuitry further including means for deenergizing the thermoelectronic refrigerator means when the sensed pressure falls below a lower limit.

26. The system of claim 25, the lower limit being approximately 295 psi.

27. The system of claim 17, the control circuitry including means for deenergizing the thermoelectronic refrigerator means when the sensed pressure falls below a lower limit.

28. The system of claim 27, the lower limit being approximately 295 psi.

29. The system of claim 19 further comprising a tube interconnecting. the vessel interior and the reaction chamber.

30. The system of claim 29 further comprising a vacuum jacket associated with the interconnecting tube.

31. The system of claim 30 further comprising a coupling between the interconnecting tube and the vessel interior which holds the vacuum jacket spaced from the pressure vessel walls.

32. The system of claim 29 further comprising a coupling between the interconnecting tube and the vessel interior which holds the interconnecting tube spaced from the pressure vessel walls.

33. The system of claim 19 further comprising a tube communicating with the vessel interior, the reaction chamber being defined at a distal end of the tube.

34. The system of claim 33 further comprising a vacuum jacket associated with the interconnecting tube.

35. The system of claim 34 further comprising a coupling between the interconnecting tube and the vessel interior which holds the vacuum jacket spaced from the pressure vessel walls.

36. The system of claim 33 further comprising a coupling between the interconnecting tube and the vessel interior which holds the interconnecting tube spaced from the pressure vessel walls.

37. The system of claim 19, the valve means including means responsive to a fire alarm condition signal for opening the valve means whereby to allow $CO_2$ to be expelled from the outlet in the event of a fire condition.

38. Apparatus for chilling a gas under pressure comprising:

a cylindrical tube having its ends sealed and having an aperture into the cylindrical tube, an interconnecting tube connected at one end to the cylindrical tube at the aperture and at another end to the gas under pressure for communicating the gas under pressure to the cylindrical tube; and thermoelectronic refrigerator means coupled to the cylindrical tube for drawing heat out of the tube whereby to chill gas under pressure within the tube.

39. The apparatus of claim 38 further comprising a vacuum jacket associated with the interconnecting tube.

40. The apparatus of claim 38, the thermoelectric refrigerator means including a thermoelectric device coupled to each end of the cylindrical tube.

* * * * *